US012000259B2

(12) United States Patent
Bhattacharjee et al.

(10) Patent No.: US 12,000,259 B2
(45) Date of Patent: Jun. 4, 2024

(54) SYSTEM AND METHODOLOGY FOR CHEMICAL DISPERSION WITHIN A WELLBORE

(71) Applicant: Schlumberger Technology Corporation, Sugar Land, TX (US)

(72) Inventors: Anirban Bhattacharjee, Houston, TX (US); Abhinandan Tripathi, Midland, TX (US); Ashutosh Dikshit, Houston, TX (US); Joshua Susmarski, Denver, CO (US); Bobby Carroll, Angleton, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/175,769

(22) Filed: Feb. 28, 2023

(65) Prior Publication Data

US 2023/0272697 A1 Aug. 31, 2023

Related U.S. Application Data

(60) Provisional application No. 63/268,621, filed on Feb. 28, 2022.

(51) Int. Cl.

| | |
|---|---|
| ***E21B 43/08*** | (2006.01) |
| ***E21B 33/12*** | (2006.01) |
| ***E21B 33/126*** | (2006.01) |
| ***E21B 37/06*** | (2006.01) |
| ***E21B 41/02*** | (2006.01) |
| ***E21B 43/38*** | (2006.01) |

(52) U.S. Cl.

CPC ..... *E21B 43/38* (2013.01); *E21B 33/12* (2013.01); *E21B 33/126* (2013.01); *E21B 37/06* (2013.01); *E21B 41/02* (2013.01); *E21B 43/08* (2013.01); *E21B 43/084* (2013.01)

(58) Field of Classification Search

CPC ..... E21B 33/126; E21B 37/06; E21B 41/02; E21B 43/08; E21B 43/088; E21B 43/084

See application file for complete search history.

(56) References Cited

U.S. PATENT DOCUMENTS 5,875,852 A * 3/1999 Floyd ..... E21B 33/124 166/387

7,243,715 B2 7/2007 Wang et al.

(Continued)

*Primary Examiner* — Shane Bomar

(74) *Attorney, Agent, or Firm* — Jeffrey D. Frantz

(57) ABSTRACT

A tubular joint. The tubular joint may include a perforated section, a filter section, a packer, and a chemical dispersion system. The perforated section includes a first plurality of orifices to allow fluid communication between a bore of the tubular joint and a first area surrounding the tubular joint proximate the perforated section. The filter section may include a filter assembly to filter fluid flowing into the bore via a second plurality of orifices from a second area proximate the filter section. The packer may be operable to isolate the first area from the second area when the tubular string is disposed within the well. The chemical dispersion system is disposed adjacent to the filter section, includes a first control line and a first dispersion manifold, and is operable to disperse treatment fluids proximate the filter section to at least reduce a buildup of blockages along the filter assembly.

20 Claims, 3 Drawing Sheets

(56) References Cited

U.S. PATENT DOCUMENTS

| | | | | |
|---|---|---|---|---|
| 2002/0088744 | A1* | 7/2002 | Echols | E21B 43/108 210/85 |
| 2004/0251020 | A1* | 12/2004 | Smith | E21B 43/12 166/236 |
| 2007/0051507 | A1* | 3/2007 | Ross | E21B 43/04 166/278 |
| 2007/0289740 | A1* | 12/2007 | Thigpen | E21B 37/06 166/250.01 |
| 2007/0295504 | A1* | 12/2007 | Patel | E21B 47/006 322/14 |
| 2008/0110614 | A1* | 5/2008 | Orban | E21B 33/126 166/101 |
| 2009/0084553 | A1* | 4/2009 | Rytlewski | E21B 43/08 166/305.1 |
| 2011/0079382 | A1* | 4/2011 | Patel | E21B 37/06 166/90.1 |
| 2011/0079398 | A1* | 4/2011 | Patel | E21B 37/06 166/373 |
| 2012/0234548 | A1* | 9/2012 | Dyer | E21B 37/06 507/260 |
| 2013/0020088 | A1* | 1/2013 | Dyer | E21B 34/063 166/373 |
| 2015/0075780 | A1* | 3/2015 | Richards | E21B 43/04 166/308.1 |
| 2015/0192001 | A1* | 7/2015 | Hall | E21B 43/086 166/205 |
| 2022/0389788 | A1* | 12/2022 | Dikshit | E21B 33/1243 |

* cited by examiner

SYSTEM AND METHODOLOGY FOR CHEMICAL DISPERSION WITHIN A WELLBORE

CROSS REFERENCE TO RELATED APPLICATIONS

The present application claims priority benefit of U.S. Provisional Application No. 63/268,621, filed Feb. 28, 2022, the entirety of which is incorporated by reference herein and should be considered part of this specification.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of casing and other well completions may be deployed downhole. Sometimes, completion systems employ or work in cooperation with an electric submersible pumping system which may be used to pump oil or other hydrocarbon fluids to a collection location.

In producing hydrocarbons or the like from certain subterranean formations, it is common to produce large volumes of particulate material (e.g., sand) along with the formation fluids, especially when the formation has been fractured to improve flow therefrom. This sand production must be controlled, otherwise it may impact the economic life of the well.

SUMMARY

A tubular joint installable on a tubular string disposable within a wellbore according to one or more embodiments of the present disclosure includes a perforated section, a filter section, a packer, and a chemical dispersion system. The perforated section is disposed proximate a first end and includes a first plurality of orifices to allow fluid communication between a bore of the tubular joint and a first area surrounding the tubular joint proximate the perforated section. The filter section is disposed proximate a second end and includes a filter assembly to filter fluid flowing into the bore via a second plurality of orifices from a second area proximate the filter section. The packer is disposed between the perforated section and the filter section and operable to isolate the first area from the second area when the tubular string is disposed within the well. The chemical dispersion system is disposed adjacent to the filter section, includes a first control line and a first dispersion manifold, and is operable to disperse treatment fluids proximate the filter section to at least reduce a buildup of blockages along the filter assembly.

A production system disposable within a wellbore according to one or more embodiments of the present disclosure includes a tubular string disposable within the wellbore and a tubular joint coupled to the tubular string. The tubular joint includes a perforated section, a filter section, a packer, and a chemical dispersion system. The perforated section is disposed proximate a first end and includes a first plurality of orifices to allow fluid communication between a bore of the tubular joint and a first area surrounding the tubular joint proximate the perforated section. The filter section is disposed proximate a second end and includes a filter assembly to filter fluid flowing into the bore via a second plurality of orifices from a second area proximate the filter section. The packer is disposed between the perforated section and the filter section and operable to isolate the first area from the second area when the tubular string is disposed within the well. The chemical dispersion system is disposed adjacent to the filter section, includes a first control line and a first dispersion manifold, and is operable to disperse treatment fluids proximate the filter section to at least reduce a buildup of blockages along the filter assembly.

A method for producing formation fluids from a formation according to one or more embodiments of the present disclosure includes positioning a tubular string comprising a tubular joint within a wellbore extending through the formation. The method also includes dispersing treatment fluids proximate a filter assembly of the tubular joint via a chemical dispersion system to at least reduce a buildup of blockages along the filter assembly. The method further includes filtering a fluid flowing from a first annulus surrounding a filter section of the tubular joint into the tubular joint via the filter assembly. The method also includes isolating the first annulus from a second annulus surrounding a perforated section of the tubular joint via a packer of the tubular joint. The method further includes flowing the filtered fluid entering the tubular joint into the second annulus via orifices in the filter section of the tubular joint.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
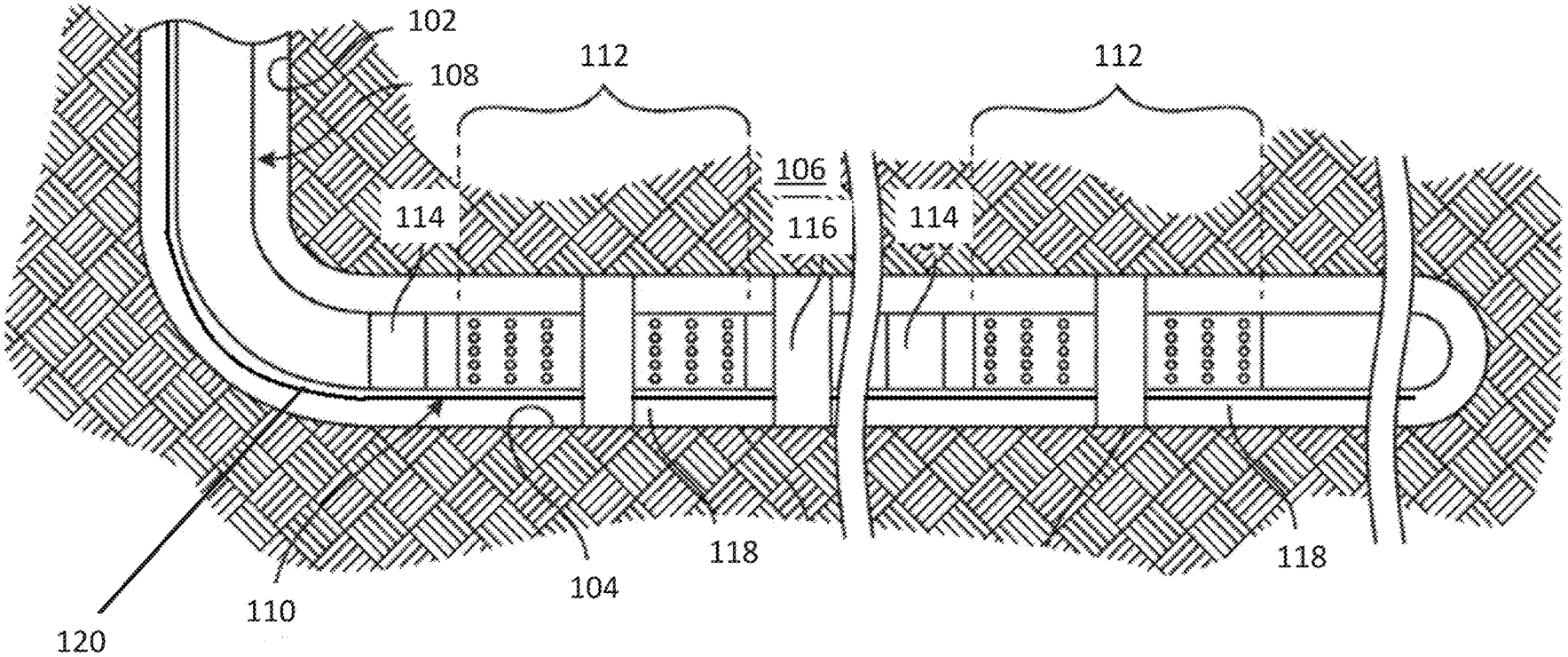
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubular string 108 is deployed downhole into wellbore 102 and comprises a downhole well completion 110 deployed in the deviated, e.g. horizontal, wellbore section 104.

The downhole well completion 110 may be constructed to facilitate production of well fluids and/or injection of fluids. By way of example, the downhole well completion 110 may comprise at least one tubular joint 112, e.g. a plurality of tubular joints 112. Each tubular joint 112 may include a filter assembly that includes a screen filter, optionally, covered by a perforated shroud, as described in more detail below, through which fluid may enter the corresponding tubular joint 112. The fluid may then be pumped uphole via electric submersible pumps ("ESPs") for production to a suitable location, e.g. a surface location. For example, reservoir fluids flow from formation 106, into wellbore 102, and into the tubular joints 112. The reservoir fluids then flow from the tubular joints 112 to the ESPs 114. In some embodiments, the downhole well completion 110 also may include one or more packers 116, which may be used to isolate sections or zones 118 along the wellbore 102.

A chemical dispersion system 120, as described in more detail below, may extend along the completion 110. The chemical dispersion system 120 provides for a circumferential dispersion of treatment fluids at multiple points along the completion. Such treatment fluids may be used, for example, to treat scale buildup or neutralize corrosive treatment fluids near a filter assembly.

Figure 2:
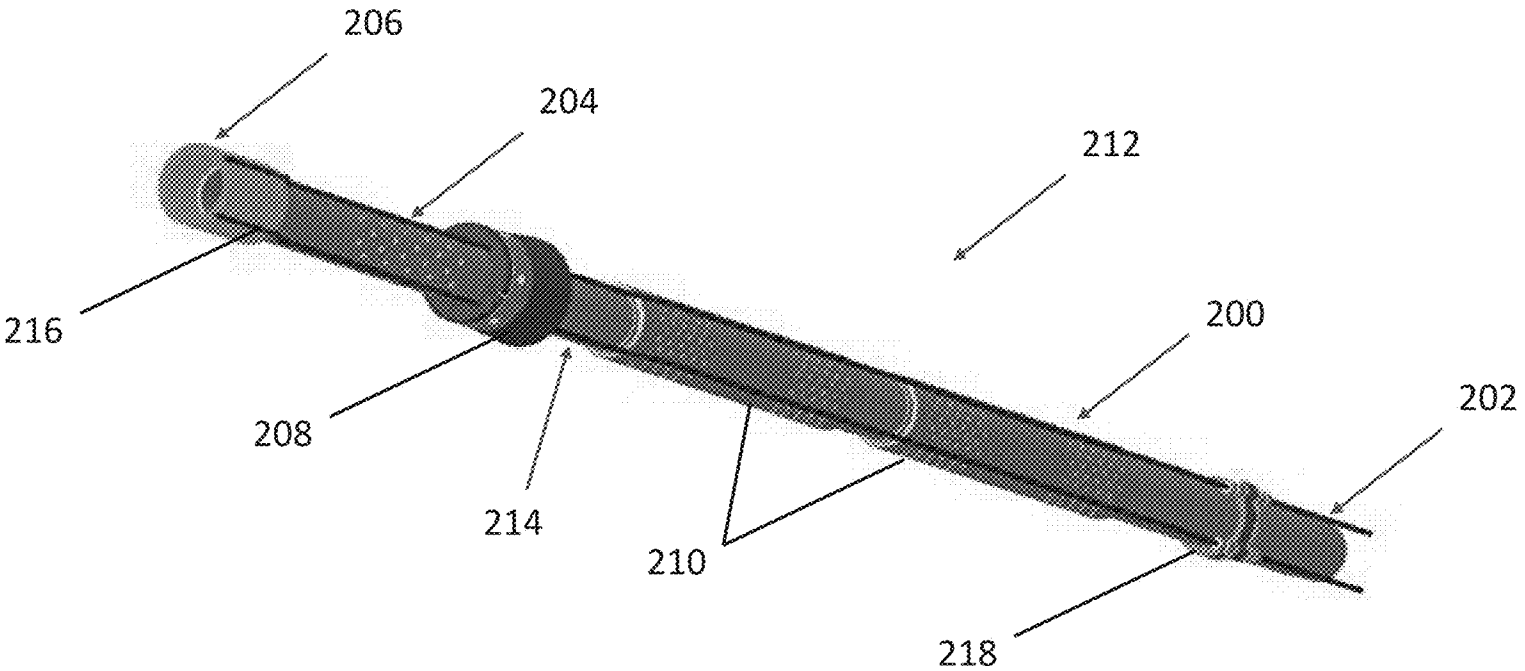
FIG. 2 is an isometric view of a tubular joint according to one or more embodiments of the present disclosure.

Turning now to FIG. 2, FIG. 2 is an isometric view of a tubular joint 212 according to one or more embodiments of the present disclosure. As described above, multiple tubular joints 212 may be coupled to a tubular string, such as the tubular string 108 described above. The tubular joint 212 includes a filter section 200 proximate a lower end 202, a perforated section 204 proximate an upper end 206, and a packer 208 disposed between the filter section 200 and the perforated section 204. According to one or more embodiments of the present disclosure, the filter section 200 includes a filter assembly 210 that includes a sand screen covered by a perforated shroud. In some embodiments, the perforated shroud may be omitted. The filter assembly 210 filters the reservoir fluids entering the tubular joint 212 to reduce the amount of particulates, i.e., sand, that enter the tubular joint 212. In one or more embodiments of the present disclosure, the sand screen of the filter assembly 210 may be a metallic sand screen, such as a MeshRite screen as described in U.S. Pat. No. 7,243,715, for example, which is incorporated by reference herein in its entirety. Although two filter assembly 210 are shown in FIG. 2, the invention is not thereby limited. Other embodiments may include one, three, or more filter assemblies 210.

The packer 208 of the tubular joint 212 may be a cup seal packer, for example, according to one or more embodiments of the present disclosure. With this configuration, the packer 208 isolates a producing zone adjacent the filter section 200 so that flow is forced through the filter section 200 for enhanced sand control. That is, in operation, the flow comes from the reservoir, flows into the filter section 200, and flows into the bore of the tubular joint 212.

As shown in FIG. 2, the tubular joint 212 further includes a chemical dispersion system 214 that includes control lines 216, which convey treatment fluids to one or more dispersion manifolds 218 coupled to the tubular joint 212. The dispersion manifold 218 allows treatment fluids to be dispersed proximate the filter section 200 to prevent or reduce the buildup of scale, corrosion, or other types of blockages along the filter assembly 210 that may reduce the amount of or prevent reservoir fluids from entering the tubular joint 212. Although only one dispersion manifold 218 is shown, the chemical dispersion system 214 may include two or more dispersion manifolds 218 coupled to one or more tubular joints 212. Further, the dispersion manifolds 218 may be located adjacent to the filter section 200, the perforated section 204, other locations along the completion, or any combination thereof.

As shown in FIG. 2, the perforated section 204 of the tubular joint 212 includes a plurality of orifices. With this configuration, the perforated section 204 is a means to convey fluid to an associated ESP located uphole of the tubular joint 212. Specifically, the orifices provide a path for the flow to exit the bore of the tubular joint 212 into an area surrounding the perforated section 204. The ESP then pumps the fluid from the area surrounding the perforated section 204 uphole.

As further shown in FIG. 2, the upper end 206 and the lower end 202 of the tubular joint 212 may include a type of threading, such as external upset end (EUE) pins, for example. An EUE coupling may be coupled to the EUE pin at the upper end 206 of the tubular joint 212, according to one or more embodiments of the present disclosure. The EUE coupling may facilitate direct or indirect coupling with the associated ESP located uphole of the tubular joint 212, for example. However, the EUE coupling may be omitted from the tubular joint 212, without departing from the scope of the present disclosure.

In either case, any threading of the tubular joint 212 is located at the upper and lower ends 206, 202 of the tubular joint 212, instead of in between one or more of the perforated section 204, the packer 208, and the filter section 200, for example. Therefore, the tubular joint 212 eliminates the need to make up the sand screen joint to the packer joint and then to the perforated pup joint. Moreover, by eliminating separate joints (i.e., multiple tubing/mandrels that have to be screwed together), the tubular joint 212 eliminates undesirable leak paths at threaded connections between one or more of the perforated section 204, the packer 208, and the filter section 200, and reduces the costs and time that would otherwise between required to assemble these sections together.

Figure 3:
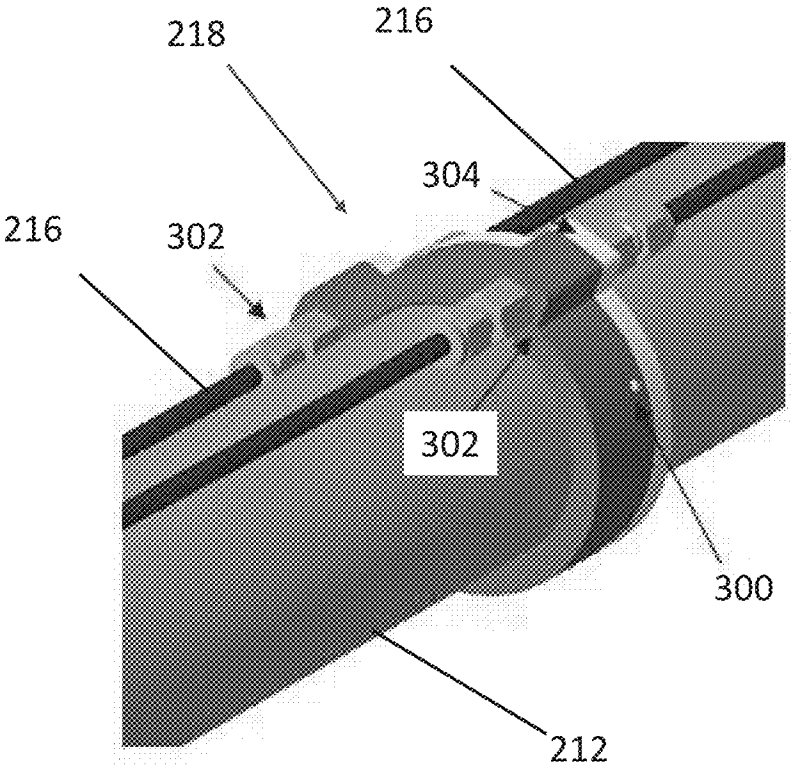
FIG. 3 is an isometric view of the dispersion manifold of the chemical dispersion system of FIG. 2.

Turning now to FIG. 3, FIG. 3 is an isometric view of the dispersion manifold 218 of the chemical dispersion system 214 of FIG. 2. The dispersion manifold 218 is circumferentially disposed around the tubular joint 212 and includes multiple orifices 300 located around the circumference of the dispersion manifold 218 and extending into a cavity of the dispersion manifold 218 to disperse treatment fluids therein around the tubular joint 212. Additionally, the size of the orifices 300 can be adjusted and the shape of the orifices 300 can be modified as necessary to adjust the flow rate of the treatment fluids to a desired flow rate.

The dispersion system further includes control lines 216 coupled to manifold inlets 302 to deliver treatment fluids to the cavity of the dispersion manifold 218. The dispersion manifold 218 may also include manifold outlets 304 that allow treatment fluids to flow from a dispersion manifold 218 to additional dispersion manifolds 218 positioned on the completion further downhole, allowing treatment fluids to be dispersed along the length of the completion.

As used herein, a range that includes the term between is intended to include the upper and lower limits of the range;

e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tubular joint installable on a tubular string disposable within a wellbore, the tubular joint comprising:

a perforated section disposed proximate a first end and comprising a first plurality of orifices to allow fluid communication between a bore of the tubular joint and a first area surrounding the tubular joint proximate the perforated section;

a filter section disposed proximate a second end and comprising a filter assembly to filter fluid flowing into the bore via a second plurality of orifices from a second area proximate the filter section;

a packer disposed between the perforated section and the filter section, the packer operable to isolate the first area from the second area when the tubular string is disposed within the well; and a chemical dispersion system disposed adjacent to the filter section, the chemical dispersion system comprising a first control line and a first dispersion manifold and operable to disperse treatment fluids proximate the filter section to at least reduce a buildup of blockages along the filter assembly.

2. The tubular joint of claim 1, wherein the filter assembly comprises a sand screen.

3. The tubular joint of claim 2, wherein the sand screen comprises a metallic material.

4. The tubular joint of claim 2, wherein the filter assembly further comprises a shroud surrounding the sand screen.

5. The tubular joint of claim 1, wherein the packer is a cup seal packer.

6. The tubular joint of claim 1, wherein the first dispersion manifold comprises a plurality of orifices located around a circumference of the first dispersion manifold and extending into a cavity of the first dispersion manifold.

7. The tubular joint of claim 1, wherein the chemical dispersion system comprises a second dispersion manifold in fluid communication with the first dispersion manifold via a second control line.

8. The tubular joint of claim 1, further comprising a second chemical dispersion system adjacent to the perforated section.

9. A production system disposable within a wellbore, the production system comprising:

a tubular string disposable within the wellbore; and a tubular joint coupled to the tubular string and comprising:

a perforated section disposed proximate a first end and comprising a first plurality of orifices to allow fluid communication between a bore of the tubular joint and a first area surrounding the tubular joint proximate the perforated section;

a filter section disposed proximate a second end and comprising a filter assembly to filter fluid flowing into the bore via a second plurality of orifices from a second area proximate the filter section;

a packer disposed between the perforated section and the filter section, the packer operable to isolate the first area from the second area when the tubular string is disposed within the wellbore; and a chemical dispersion system disposed adjacent to the filter section, the chemical dispersion system comprising a first control line and a first dispersion manifold and operable to disperse treatment fluids proximate the filter section to at least reduce a buildup of blockages along the filter assembly.

10. The production system of claim 9, wherein the filter assembly comprises a sand screen.

11. The production system of claim 10, wherein the filter assembly further comprises a shroud surrounding the sand screen.

12. The production system of claim 9, further comprising an electric submersible pump ("ESP") coupled to the tubular string and positioned uphole of the tubular joint when the tubular string is disposed within the wellbore.

13. The production system of claim 12, wherein the ESP is coupled to the first end of the tubular joint.

14. The production system of claim 9, wherein the packer is a cup seal packer.

15. The production system of claim 9, wherein the first dispersion manifold comprises a plurality of orifices located around a circumference of the first dispersion manifold and extending into a cavity of the first dispersion manifold.

16. The production system of claim 9, wherein the chemical dispersion system comprises a second dispersion manifold in fluid communication with the first dispersion manifold via a second control line.

17. The production system of claim 9, further comprising a second chemical dispersion system adjacent to the perforated section.

18. A method for producing formation fluids from a formation, the method comprising:

positioning a tubular string comprising a tubular joint within a wellbore extending through the formation;

dispersing treatment fluids proximate a filter assembly of the tubular joint via a chemical dispersion system to at least reduce a buildup of blockages along the filter assembly;

filtering a fluid flowing from a first annulus surrounding a filter section of the tubular joint into the tubular joint via the filter assembly;

isolating the first annulus from a second annulus surrounding a perforated section of the tubular joint via a packer of the tubular joint; and flowing the filtered fluid entering the tubular joint into the second annulus via orifices in the filter section of the tubular joint.

19. The method of claim 18, further comprising pumping the filtered fluid within the second annulus uphole via an ESP.

20. The method of claim 18, further comprising flowing the treatment fluids to a dispersion manifold of the chemical dispersion system via control lines.

* * * * *